United States Patent [19]

Keilhack

[11] Patent Number: 5,046,209

[45] Date of Patent: Sep. 10, 1991

[54] BATCH DYEING AND WASHING APPARATUS AND METHOD

[75] Inventor: Hans O. Keilhack, Charlotte, N.C.

[73] Assignee: Keiltex Corporation, Charlotte, N.C.

[21] Appl. No.: 511,466

[22] Filed: Apr. 20, 1990

[51] Int. Cl.[5] ..... D06B 3/16; D06B 3/32

[52] U.S. Cl. ..... 8/152; 8/158; 68/22 R; 68/62; 68/177; 68/180

[58] Field of Search ..... 8/152, 158; 68/22 R, 68/27, 62, 177, 180, 184, 205 R

[56] References Cited

U.S. PATENT DOCUMENTS 3,616,663 11/1971 Matsuda ..... 68/177 X
3,969,074 7/1976 Chung ..... 68/62 X
4,793,014 12/1988 Luigi ..... 68/177 X

FOREIGN PATENT DOCUMENTS 3612499 11/1986 Fed. Rep. of Germany ..... 68/22 R
2065 1/1972 Japan ..... 68/27

*Primary Examiner*—Philip R. Coe
*Attorney, Agent, or Firm*—Bailey & Hardaway

[57] ABSTRACT

A batch dyeing machine 10 has separate imperforate compartments A and B for facilitating washing of a length of fabric as it is transported from one compartment to the other. A squeeze roll 50 prevents used wash water from passing from one compartment into the other with the fabric. By separating the compartments, wash liquid is conserved in that only one of the compartments need be filled at a time and a counterflow wash system is provided. Thus, the washing capabilities of a batch dyeing machine have been enhanced.

14 Claims, 6 Drawing Sheets

Fig. 3.
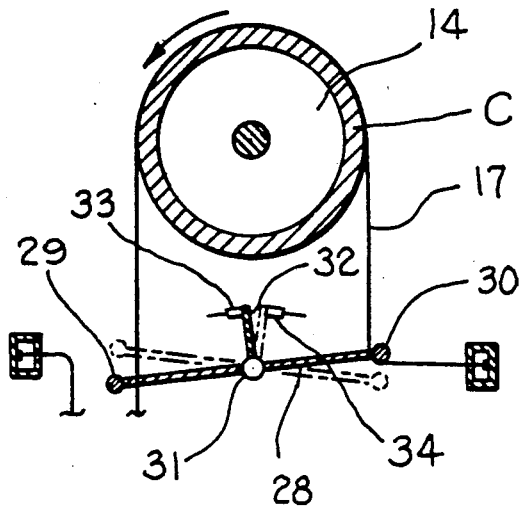
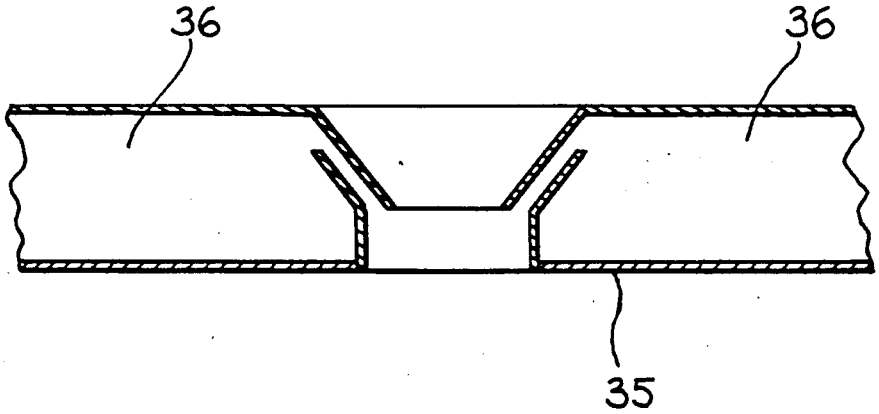
Fig. 4.

BATCH DYEING AND WASHING APPARATUS AND METHOD

BACKGROUND OF THE INVENTION

This invention is an improvement relating to the apparatus and method of U.S. Pat. No. 4,793,014 the disclosure of which is incorporated herein and made a part hereof by reference.

The washing function of the machine of U.S. Pat. No. 4,793,014 is limited due to the relatively small amounts of wash liquid coming from the nozzles and because of the fact that the respective parts or compartments are connected through and beneath the perforate partition. Thus, wash liquid fills the compartments resulting in excessive use of liquid, and because the used wash liquid is mixed with fresh liquid the washing action is not as effective as it would be without such mixing.

Accordingly, it is an important object of the invention to provide a batch dyeing and washing apparatus and method of the type disclosed in U.S. Pat. No. 4,793,014 utilizing at least two adjacent imperforate compartments so that only one of the two imperforate compartments or containers is filled with wash liquid at any one time.

Another object of the invention is to provide a squeeze roll at the top of the apparatus for squeezing out used wash liquid to prevent same from moving from one imperforate compartment into the other.

Still another important object of the invention is to maximize the effectiveness of the wash water utilized in the washing operation of a batch dyeing apparatus which minimizes the amount of wash water used by providing a counterflow rinse system in the imperforate compartments.

SUMMARY OF THE INVENTION

The washing capabilities of apparatus and process for the treatment, in particular for the batchwise dyeing of fabrics, are improved. The fabric may be dyed inside a treatment container or vat, by being collected from one part of the vat and being laid down in another part of the vat, and undergoes the action of the treatment liquid during its movement inside the container, characterized in that the fabric is kept fixed at its ends, inside the container, and is alternately gathered inside the one, and the other part of the container, with it being contacted by the treatment medium during the step of passage from either part to the other part of the container with subsequent washing of the fabric.

For the purpose of embodying this process, a machine is provided according to the invention, which comprises a treatment container or vat, and a motor-driven winch performing the task of moving the fabric from either part to the other part of the container, the fabric undergoing the action of a treatment liquid during its movement inside the container, characterized in that inside the container means are provided for fastening the two ends of the fabric, and that a fabric transport means including a winch can be alternately driven opposed directions, for lifting the fabric from one part of the container, and then transporting it to the other part of the container, and vice-versa, along the route of the fabric between said two parts of the container means being provided for delivering the treatment liquid to the fabric.

The method and apparatus for washing a length of fabric in a batch dyeing machine according to the invention includes providing a pair of adjacent imperforate compartments. The length of fabric is transported from one of the compartments to the other while applying fresh wash water on said fabric as it enters the other of said compartments. The wash water collected in the other of said compartments is simultaneously pumped and applied on the fabric as it is transported from the said one of said compartments. The wash liquid applied on the fabric as it is transported from said one of said compartments is removed by squeezing before applying the fresh water. The method is repeated by reversing the direction of transporting and application of wash water.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 shows a schematic view of an electromechanical control means for the automatic reversal of the fabric travelling direction;

FIG. 4 is a schematic sectional elevation illustrating an ejector or nozzle constructed in accordance with a modified form of the invention;

DESCRIPTION OF A PREFERRED EMBODIMENT

Apparatus for dyeing and then washing a length of fabric includes a pair of adjacent imperforate compartments A and B. Means for feeding the length of fabric from an open top of one of the compartments through an open top into the other of the compartments preferably includes a driven winch C. Means including a respective water line D is provided for pumping fresh wash liquid into said other of the compartments while feeding wash liquid from the other of the compartments into said one of the compartments. Means for feeding the length of fabric from the other of said compartments into said one of said compartments while excluding wash liquid from said one of said compartments includes a reversing mechanism for the winch. Means for pumping wash liquid into said other of said compartments while feeding includes a respective water line D.

Thus, the amount of liquid required for washing is reduced.

The method contemplates depositing the length of fabric in a first stationary imperforate container. A driven transport means is provided having stationary tangential substantially vertical fabric delivery on respective sides thereof in combination with a stationary nozzle E which is substantially vertically below each respective delivery. The fabric is lifted substantially vertically in running length from the first stationary imperforate container through an adjacent stationary nozzle by the transport means, and wash liquid is pumped through the adjacent stationary nozzle while lifting the fabric. The fabric continues to move in running length substantially vertically downwardly from a stationary tangential delivery in a substantially tensionless state while fresh wash liquid is applied from a stationary nozzle to the fabric and deposited in an adjacent second stationary imperforate container. The direction of movement of the fabric is then reversed and again lifts the fabric upwardly in running length from the adjacent stationary container. A wash liquid is then again applied to the fabric while continuing to move the fabric in running length, prior to depositing same vertically in the first stationary container. Thus, washing may be carried out utilizing reduced wash liquid since only one compartment need be filled at a time.

Figure 1:
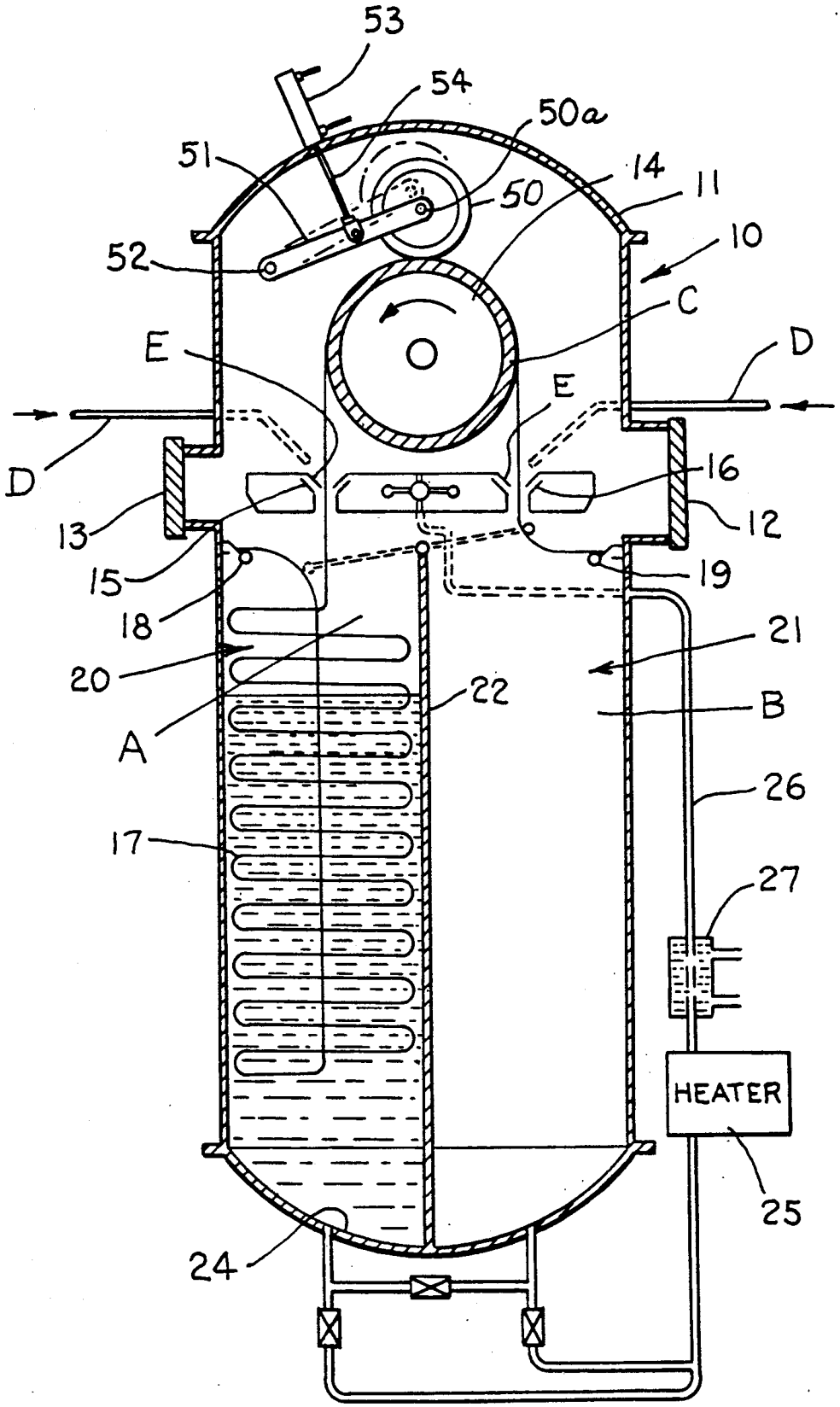
FIG. 1 shows a schematic transverse sectional view of a machine according to the invention, with the fabric being gathered inside one of the two interior imperforate compartments which subdivide the container into two parts or imperforate compartments.

Wash liquid can be used for two transports of the fabric. In FIG. 1, for example, fabric may be transported from compartment A to B, then from B to A using pumping means extracting the washing liquid from compartment B to the nozzle in compartment A. Or, while in transfer from compartment B back to A, washing liquid can be extracted by pumping means from compartment B to the nozzle over compartment B creating a backwash. Simultaneously fresh wash water can come in over the nozzle of compartment A into compartment A. This will complete second half of two transport wash, concurrent with the first step of another two-step wash. Thus, by the time a compartment is filled with cloth and water the water has contacted the cloth twice rather than once.

Figure 2:
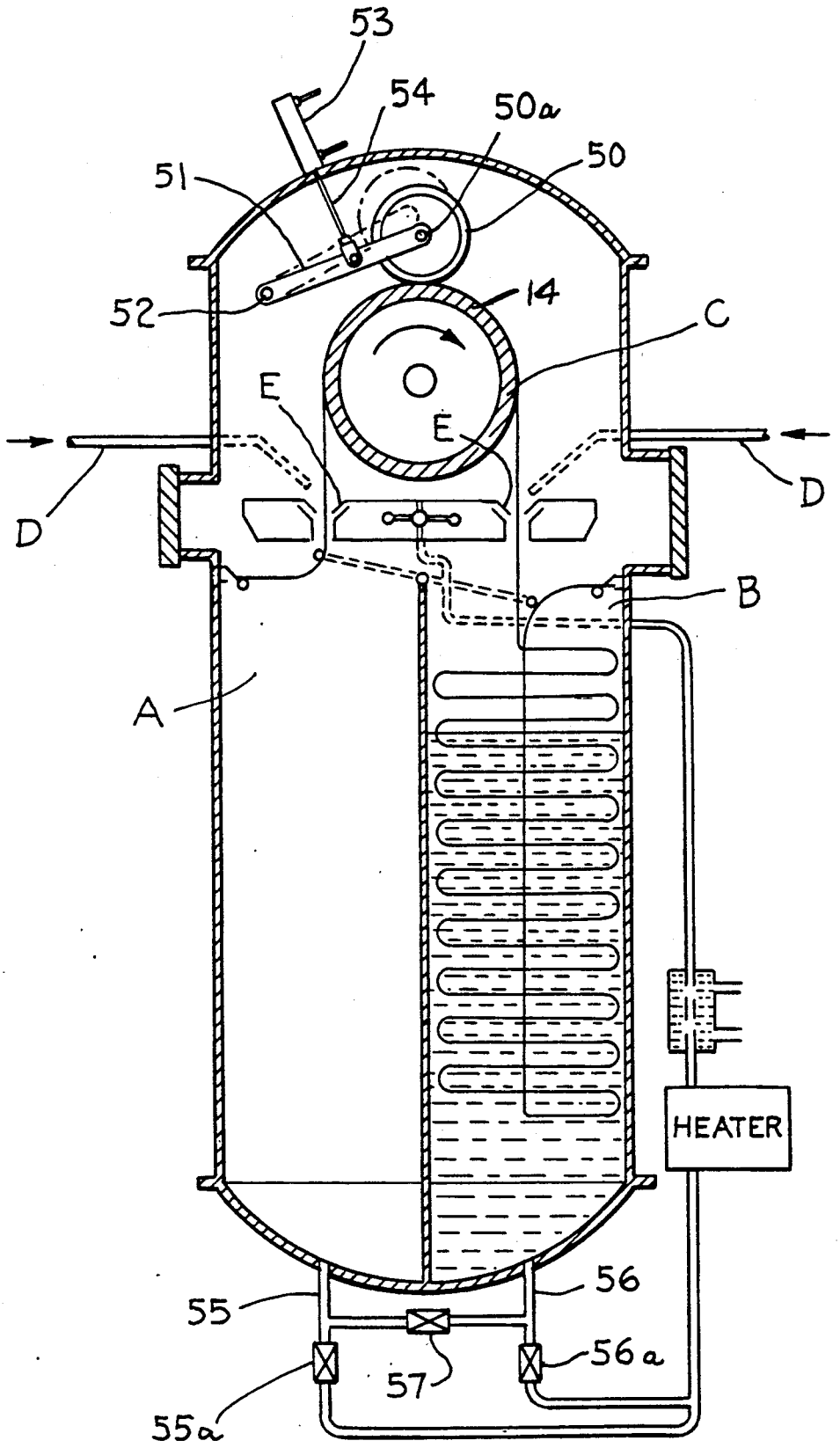
FIG. 2 shows the machine of FIG. 1, with the fabric being gathered in the compartment opposite to the compartment of FIG. 1.

Referring to FIGS. 1 and 2, a machine for the treatment of a running length of fabric according to the present invention comprises a container broadly indicated at 10, and preferably provided with a top cover 11. Advantageously, the container 10 is positioned with its axis being vertical.

The container 10 has, in two opposite side areas, two openings, preferably closeable, such as at 12 for entering the container and charging the fabric to it, and a porthole 13 for accessing the container 10 and performing the necessary operations.

Inside the container 10, in the upper portion of the container, a motor-driven winch 14 is provided, which, together with the ejectors, nozzles or applicators 15 and 16 positioned beneath the winch 14, on opposite sides relatively to the vertical middle plane of the winch, performs the task of transporting the fabric 17 to be processed. The fabric 17 is not closed in endless configuration, but is constrained at both of its ends to two fixed points by means or leaders of suitable fastening means 18 and 19 inside the container 10, provided on diametrically opposite sides in the upper portion of the container 10, under the winch 14, respectively adjacent of the porthole 13 and of the opening 12. As can be seen in the drawing, the two systems of ejectors 15 and 16 are positioned at an intermediate level between the winch 14 and the fastening means 18 and 19, along the route which the fabric 17 travels.

Under the motor-driven winch 14 and the ejectors 15 and 16, the container 10 is advantageously subdivided into at least two compartments 20 and 21 by an imperforate vertical wall 22 which extends down to the bottom of the container 10.

During a dyeing cycle, the ejectors 15 and 16 are alternatively fed the same dyeing liquid, according to the position of a three-way valve 23 associated with the ejectors.

The treatment liquid is sprayed by the ejectors 15 and 16 and collected in a region 24 on the bottom of the container 10 and then, by means of a pump 25, is recycled through a pipe 26 which reaches the valve 23. With the pipe 26, a heat exchanger 27 is associated, in order to heat/cool the treatment liquid to the necessary temperature for the type of treatment to be carried out, during both the heating and cooling steps.

The winch 14 can be alternately actuated in either direction. The reversal of the direction of revolution of the winch 14 takes place in conjunction with the reversal of the position of the distribution valve 23, in such a way that when the winch 14 turns in a certain direction (FIG. 1 or FIG. 2), the valve 23 delivers the liquid to that one of the ejectors 15 or 16, which forces the liquid to the direction concurrent with the direction of travelling of fabric 17.

The treatment of the fabric by means of the disclosed machine takes place as follows.

An end of the fabric 17 to be treated is introduced inside the container 10, through the opening 12, is laid down upon the winch 14, and is inserted through the ejector 15, using the opening provided by the porthole 13.

At this point, the winch 14 is started up; it makes it possible to recover the end of the fabric 17, and to hook it at 18. Then, with the aid of the bath solution delivered by the pump 25 into the ejector 15, the laying down the fabric 17 in the form of wet laps inside the compartment 20 of the container 10 is attained, while the fabric 17 continues to be fed from the outside through the opening 12, which remains open.

After the loading is completed, the rear end of the fabric 17 is hooked at 19, after being inserted inside the ejector 16. The winch 14 is now driven in the opposite direction, and only the ejector 16 starts operating, which contributes to continuously move the fabric, which, while is being soaked with the treatment liquid, gathers inside the compartment 21, emptying the compartment 20 (FIG. 2).

At the end of passage of fabric 17 from compartment 20 to compartment 21, the direction of revolution of the winch 14 is reversed, and the ejector 15 starts operating, with the result that the fabric is brought back into the compartment 20, and so on, for a determined number of times, pre-established as a function of the type of treatment and/or of the type of fabric, or of other parameters. The fabric 17 is hence alternately gathered inside the one, and then inside the other, part of the container, while it is kept fixed at its ends inside the container 10, and is treated with the treatment medium during its passage from one side to the other side of the container 10.

The reversal of the direction of revolution of the winch 14, and the switching of the valve 23 can be taken place also automatically, as a function of the position of the fabric, by being controlled by the same fabric at the end of the gathering inside the one, or inside the other, of the compartments 20, 21. For example, as shown in FIG. 3, under the ejectors 15 and 16, a rocker arm 28 can be provided, positioned symmetrically relatively to the vertical middle plane of the winch 14, at the ends of said rocker arm 28 guide rollers 29 and 30 for the fabric 17 being provided. With the rocker 28 pivoted upon is, the fulcrum 31 thereof, a movable element 32 of an electrical contact, which, according to the position of the rocker arm, closes on the one, or on the other one of two stationary contacts 33, 34, a circuit which actuates the valve 23 and of the motor means of the winch 14 respectively in the one, or in the other direction. The shift of the rocker arm 28 is caused by the same fabric at its stroke end, due to the tension of the fabric in that position.

In FIG. 4, a form of ejector or nozzle is shown, which can be advantageously used in the machine as disclosed, and wherein the bottom walls 35 of the collection chambers 36 for the pressurized liquid exiting the ejectors are perforated for the purpose of sprinkling the fabric 17. It is thus possible to sprinkle the fabric in a more uniform way, while the filling of the respective compartments 20 or 21 with the rope or open width fabric in folds or laps is taking place.

Figure 5:
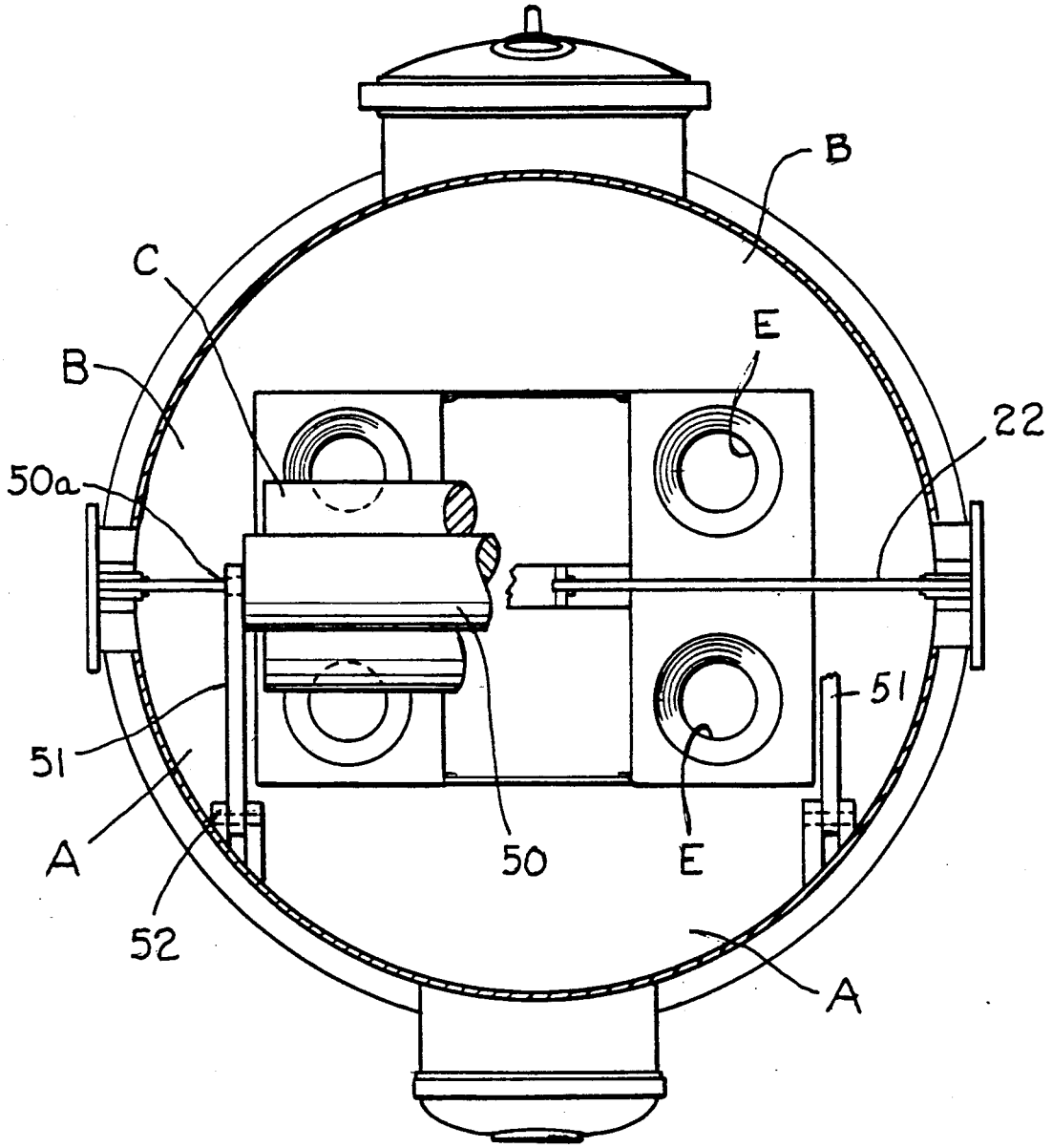
FIG. 5 shows a plan view of the apparatus.

It will be noted with reference to FIGS. 1, 2 and 5 that, in order to facilitate washing, the partition 22 is imperforate and extends all the way to the bottom of the vessel. The squeeze roll 50 has a central stub shaft 50*a* which is oscillatably carried for pivotal movement in the arm 51 which is pivotally connected as at 52 to the vessel. A suitable fluid cylinder 53 having extensible means such as a piston rod 54 is provided for pivoting the squeeze roll 50 out of the way as shown in FIGS. 1 and 2 in dotted line position. The squeeze rolls further prevent used wash liquid from moving from one compartment into the other.

In operation the circulation pump is turned off, the machine is drained completely and fresh water or other wash liquid is pumped through the venturi of the compartment where the fabric is piled up. A lifter reel then pulls the fabric through the venturi, and a small squeeze roller on top prevents used water from running into the empty chamber. After the chamber has been emptied of fabric, the fresh water supply is shut off, and the cloth transport direction will be reversed so that the machine will be drained and the procedure is reversed, permitting fresh water to go through the respective nozzles.

The imperforate compartments 20 and 21 are completely separated except for a connection through the lines 55 and 56 which are provided with suitable valves 55*a* and 56*a*. The lines are connected through a valve 57 which would provide operation as formally provided by the apparatus of U.S. Pat. No. 4,793,014. Drainage means (not shown) are provided for the respective imperforate compartments.

Figure 6:
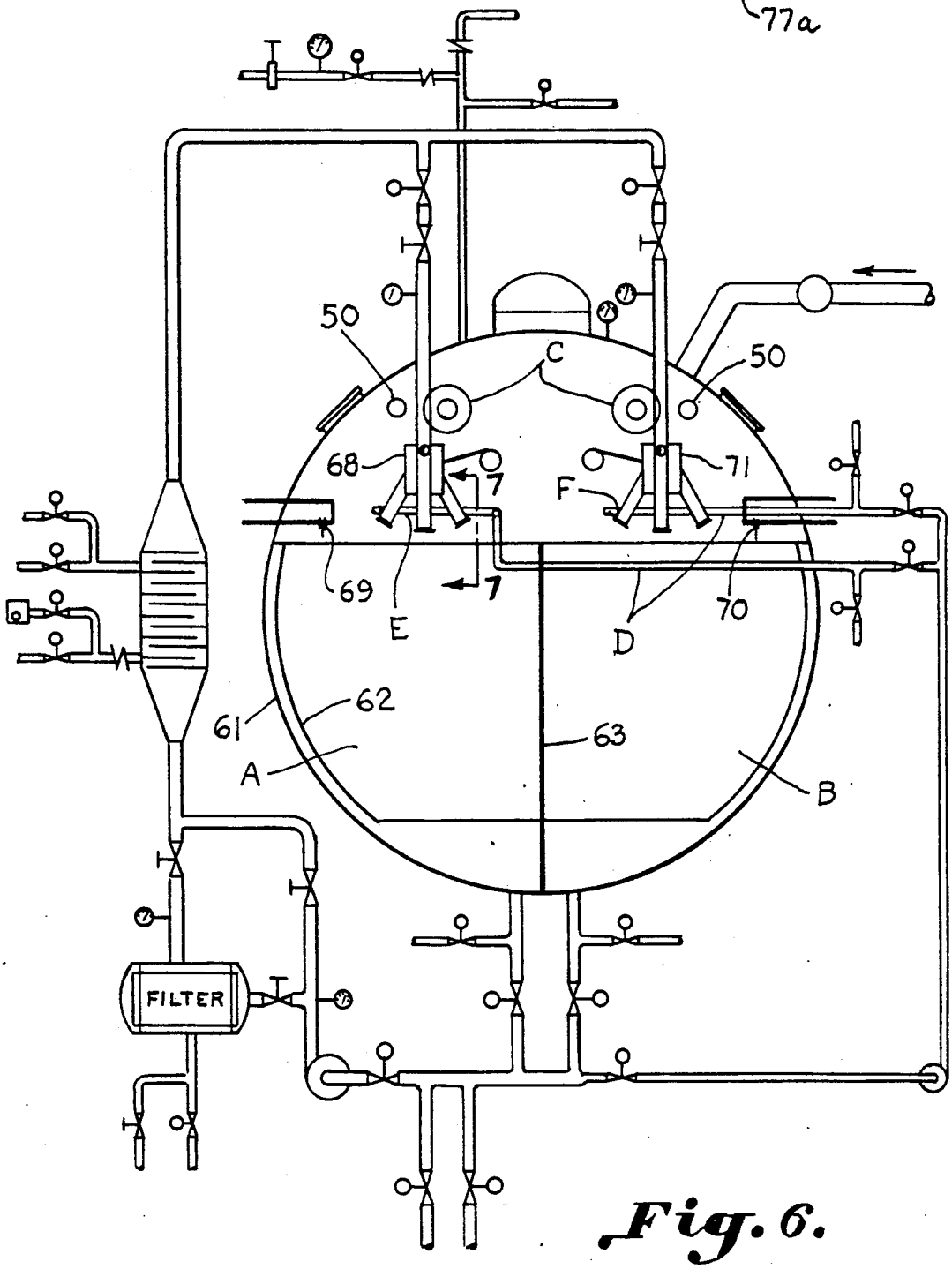
FIG. 6 is a schematic end view of a horizontal batch dyeing apparatus including washing apparatus constructed in accordance with a modified form of the invention.

FIG. 6 illustrates a modified form of the invention including a horizontal batch dyeing machine including a shell or pressure vessel 61 having a chamber or container having a liner 62. Such a liner is conventional in such apparatus and is useful in ensuring proper pump operation as the cloth is piled up in respective compartments. An imperforate partition or divider is illustrated at 63 separating the chamber into imperforate compartments.

The wash water pump 67 is started, the compartment A shut off valve is opened and the winches or rolls C are turned in counterclockwise direction to feed fabric down through the compartment A nozzle or flood box 68. The machine is stopped and the leading end of fabric is tied in compartment A to the system reverse switch 69. The pump is started again and compartment A is filled. The fabric is then tied on the other end to the system reversing switch 70 in compartment B. The dyeing machine is now ready for operation.

Fluid is pumped to the plaiting flood box 71 in compartment B. The transport means including the winches C turn clockwise pulling fabric from compartment A to compartment B through the nozzle of the plating flood box 69. When compartment B fills and compartment A empties, the fabric actuates the system reversing switch in compartment A.

With compartment B full and compartment A empty, the system is reversed. The compartment B valve is closed and the compartment A valve has been opened, and the transport mechanism C turns counterclockwise pulling fabric from compartment B to compartment A through the plaiting flood box in compartment A. When compartment A is full and compartment A is empty, the fabric will close the reversing switch 70 in compartment B reversing the process. This reversing process from compartment B to compartment A continues through dyeing and washing.

Washing is accomplished with fabric in compartment A and the rolls of transport means C operating in a clockwise direction air pressure is applied to the compartment A nip roll 50. Compartment B is filled and compartment A is empty. The fabric pulls open the system reversing switch and the cycle reverses.

With cloth in compartment B, compartment B is drained. The wash pump is then started. The transport means C is run in a counterclockwise direction, and air pressure is applied to the compartment B nip roll. Then compartment A is full, and compartment B is empty. The fabric pulls on the system reversing switch, and the cycle reverses. At the end of a wash cycle, cloth must be in compartment A for unloading. The steps may be repeated as often as desired.

Figure 7:
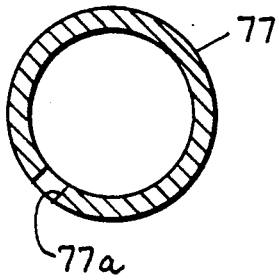
FIG. 7 is an enlarged sectional elevation taken on the line 7—7 in FIG. 6.

FIG. 7 is a sectional elevation through pipe 77 disposed in a circle about respective fabric deliveries forming an auxiliary nozzle to the associated flood box. Circumferentially spaced openings 77*a* serve as spray nozzles for washing the fabric.

Figure 8:
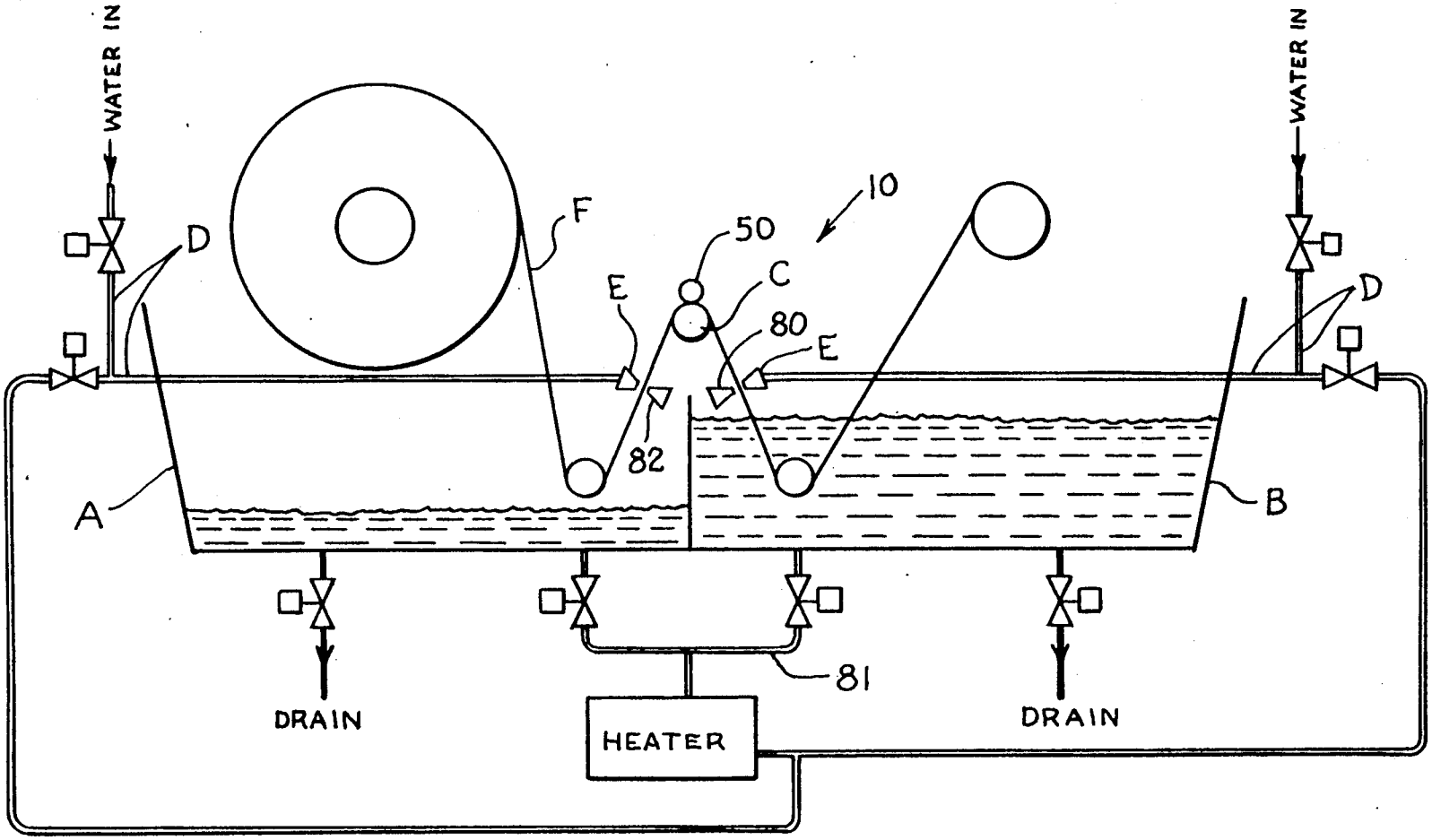
FIG. 8 is a schematic side elevation illustrating a modified form of the invention in a jigger batch dyeing machine.

FIG. 8 schematically illustrates a jigger type batch dyeing machine constructed with a counter flow rinse system in accordance with the invention. Fabric F is illustrated as being fed by the winch C from the open top of the imperforate compartment A into and adjacent imperforate compartment B. Fresh wash water fed by a line D is being sprayed by the nozzles 80 while once used water is pumped through the line 81 to be applied through the nozzles 82 to the fabric. The squeeze roll 50 prevents used wash liquid from flowing from one compartment into the other. The process may be reversed as desired.

Thus, the washing efficiency of the dyeing apparatus is increased and water consumption and cycle times are decreased.

While a preferred embodiment of the invention has been described using specific terms, such description is for illustrative purposes only, and it is to be understood that changes and variations may be made without departing from the spirit or scope of the following claims.

What is claimed is:

1. The method of washing a length of fabric after dyeing comprising the steps of:

depositing said length of fabric in a first stationary imperforate container;

providing driven transport means having a fabric delivery on respective sides thereof in combination with a stationary fluid delivery apparatus adjacent each respective fabric delivery;

lifting the fabric in running length from said first stationary imperforate container adjacent a fluid delivery apparatus by said transport means;

continuing to move the fabric in running length downwardly from a fabric delivery while applying fresh wash liquid from a stationary fluid delivery apparatus to said fabric and depositing said fabric together with said wash liquid in an adjacent second stationary imperforate container;

simultaneously pumping wash liquid from said second container through said adjacent fluid delivery apparatus while lifting the fabric;

then reversing the direction of movement of the fabric again lifting the fabric upwardly in running length from said adjacent stationary container; and then again simultaneously applying wash liquid to said fabric while continuing to move said fabric in running length, prior to depositing same in said first stationary container;

whereby washing may be carried out utilizing reduced wash liquid since only one compartment need be filled at a time.

2. The method set forth in claim 1 utilizing a driven winch transport means, and providing a squeeze roller adjacent said winch to remove excess wash liquid.

3. The method set forth in claim 2 including utilizing fluid operated cylinders for moving said squeeze roller away from said winch during dyeing, and means pumping a liquid dye medium from each container.

4. Apparatus for dyeing and then washing a length of fabric comprising:

a pair of adjacent imperforate compartments;

means for feeding said length of fabric from an open top of one of said compartments through an open top of and into the other of said compartments;

means for pumping used wash liquid from a compartment onto said length of fabric while feeding said length of fabric from said one of said compartments into the other of said compartments; and means for simultaneously pumping fresh wash liquid onto said length of fabric and into said other of said compartments while feeding said length of fabric therein;

whereby liquid is applied twice to said fabric thus reducing the amount of liquid required for washing.

5. The structure set forth in claim 4 including means for squeezing excess wash liquid from said length of fabric prior to passage thereof into one or the other of said compartments.

6. The structure set forth in claim 5 wherein said apparatus is a vertical batch dyeing machine including a vertical pressure vessel within which said compartments are formed.

7. The structure set forth in claim 6 including a pair of spaced pivoted arms carrying ends of said squeeze roll, and an extensible means for moving said pivoted arms for moving said squeeze roll away from said winch.

8. The structure set forth in claim 5 wherein said apparatus is a horizontal bath dyeing machine including a horizontal pressure vessel within which said compartments are formed.

9. The structure set forth in claim 5 wherein said apparatus is a jigger batch dyeing machine including open dyeing vessels forming adjacent imperforate compartments.

10. The structure set forth in claim 5 including plating means for depositing said fabric in each of said compartments.

11. The structure set forth in claim 4 wherein said means for feeding said length of fabric is a driven winch carried between said imperforate compartments, and a squeeze roll bearing against said winch.

12. The method of washing a length of fabric in a batch dyeing machine comprising:

providing a pair of adjacent imperforate compartments;

transporting said length of fabric from one of said compartments to the other while applying fresh wash liquid on said fabric as it enters the other of said compartments; and simultaneously pumping wash liquid collected in a compartment and applying same on said fabric as it is transported from the said one of said compartments.

13. The method set forth in claim 12 including the step of removing wash liquid applied on said fabric as it is transported from the said one of said compartments before applying said fresh wash liquid.

14. The method set forth in claim 13 including reversing the direction of transporting said length of fabric as well as applying fresh wash liquid and pumping wash liquid.

* * * * *